US006270021B1

(12) United States Patent
Bolton

(10) Patent No.: US 6,270,021 B1
(45) Date of Patent: Aug. 7, 2001

(54) LIQUID DISPENSING APPARATUS

(76) Inventor: Terence William Bolton, 148 Portland Road, Hove, East Sussex, BN3 5QL (GB)

( * ) Notice: Subject to any disclaimer, the term of this patent is extended or adjusted under 35 U.S.C. 154(b) by 0 days.

(21) Appl. No.: 09/230,015

(22) PCT Filed: Jul. 15, 1997

(86) PCT No.: PCT/GB97/01933

§ 371 Date: May 17, 1999

§ 102(e) Date: May 17, 1999

(87) PCT Pub. No.: WO98/03269

PCT Pub. Date: Jan. 29, 1998

(30) Foreign Application Priority Data

Jul. 20, 1996 (GB) ..... 9615308

(51) Int. Cl.[7] ..... B05B 9/00

(52) U.S. Cl. ..... 239/326; 239/145; 239/337; 239/346; 239/351; 239/355; 239/419; 222/187; 222/633; 222/687

(58) Field of Search ..... 239/326, 337, 239/346, 351, 355, 356, 363, 371, 372, 338, 368, 369, 398, 418, 419, 423, 145, DIG. 14; 222/187, 209, 630, 633, 637

(56) References Cited

U.S. PATENT DOCUMENTS

| | | | | |
|---|---|---|---|---|
| 2,284,591 | * | 5/1942 | Rose | 239/363 X |
| 2,354,063 | | 7/1944 | Rose . | |
| 2,354,064 | * | 7/1944 | Rose | 239/326 |
| 3,367,330 | * | 2/1968 | Sierpin | 239/356 X |
| 5,046,667 | * | 9/1991 | Fuhrig | 239/355 X |
| 5,156,684 | * | 10/1992 | Mayer et al. | 239/326 X |
| 5,190,220 | | 3/1993 | Bolton . | |
| 5,687,886 | * | 11/1997 | Bolton | 239/145 X |
| 5,716,007 | * | 2/1998 | Nottingham et al. | 239/351 X |

FOREIGN PATENT DOCUMENTS

| | | |
|---|---|---|
| 82 16 437 U | 1/1983 | (DE) . |
| 37 31 464 | 4/1989 | (DE) . |
| 91 00 840 U | 4/1991 | (DE) . |
| 0 092 359 | 10/1983 | (EP) . |
| 2 257 058 | 1/1993 | (GB) . |
| 94 26421 | 11/1994 | (WO) . |
| 97 03757 | 2/1997 | (WO) . |

* cited by examiner

*Primary Examiner*—Lesley D. Morris
*Assistant Examiner*—Steven J. Ganey
(74) *Attorney, Agent, or Firm*—Kinney & Lange, P.A.

(57) ABSTRACT

Liquid dispensing apparatus comprises a tubular casing having at one other end an inlet nozzle connectable to a source of gas under pressure and at its end an outlet nozzle having an orifice in communication with an expansion chamber bounded by sides which diverge away from or converge towards the orifice. The liquid dispensing apparatus containing a pen-like liquid source having an absorbent nib at least partially within the casing with the nib within or in close proximity to the nozzle orifice. The pen-like source may comprise a felt-tipped pen.

10 Claims, 6 Drawing Sheets

LIQUID DISPENSING APPARATUS

BACKGROUND OF THE INVENTION

This invention relates to apparatus for dispensing a fine spray of liquid particles and more especially to liquid dispensing apparatus known as air brushes.

Conventional air brushes comprise a liquid store connected to receive high pressure gas from a source. The high pressure gas passes over the liquid store to produce a spray of liquid particles which is directed by a nozzle onto an appropriate surface. The pressurised gas from the source is supplied to the air brush via a conduit and its flow is controlled by a manually operated or automatically controlled valve. Typically the pressurised gas source includes propellant and is contained in a heavy metal cylinder. JP-A-61042350 and UK 2177620A disclose such an air brush in which the liquid store takes the form of a felt-tipped pen.

My British Patent 2245196 and International Patent Application PCT/GB93/02332 disclose air brush apparatus for dispensing fine sprays of liquid particles. These air brushes comprise a hand or foot operated pump connected to supply air under pressure directly to a nozzle so positioned that air leaving the nozzle is directed onto and over a nib of a felt-tipped pen realisably supported within a holder with the absorbent nib of the pen in close proximity to the nozzle outlet to cause liquid from the nib to be dispensed as a fine particulate spray in air.

An airbrush including a cylindrical housing formed with a mouthpiece for use with a felt-tipped pen is disclosed in published British Patent Application 2257058. The pen disclosed in this application is of special design and includes an end cap formed with a hole to equalise the pressure within the pen reservoir to avoid the presence of a vacuum.

An improved tubular construction of air brush dispenser is disclosed in my International Patent Application PCT/GB94/00595. This dispenser comprises a hollow tubular housing and a felt-tipped pen which is retained within and spaced from the inner wall of the housing. The tubular housing includes at one end a nozzle and at its other end a mouth piece through which air can be caused to flow through the tubular housing and over the pen to the outlet orifice of the nozzle. An abutment is provided within the housing for locating the pen within the housing with its absorbent nib at least partially within the boundary of the outlet orifice of the nozzle.

A further and improved dispenser is disclosed in my co-pending British Patent Application 9514671.8 which, as for my earlier Application PCT/GB94/00595, removes the need for a pump but which, by a blowing action, causes the required fine spray of coloured particles to be removed from a liquid store such as an absorbent nib of a pen containing a colorant, ink, paint or the like. The air brush dispenser of my later application is an improvement over my earlier design in that it provides a simple and very secure means for locating a pen or cartridge within the tubular casing and has an outlet nozzle whose profile optimises the flow of air around the nib of the pen or other liquid source thereby enabling even young children to operate the dispenser to achieve colouring effects normally associated with much more expensive and complicated equipment.

The present invention sets out to provide alternative dispensers to those disclosed in my earlier application.

SUMMARY OF THE INVENTION

According to the present invention in one aspect, there is provided liquid dispensing apparatus which comprises a tubular casing having at one end an inlet nozzle connectable to a pump providing a source of gas under pressure and at its end an outlet nozzle having an orifice in communication with an expansion body bounded by sides which diverge away from or converge towards the orifice, and means for locating a liquid source including an elongate body and an absorbent nib at least partially within the casing with the nib substantially within the nozzle orifice.

The liquid source may comprise a pen formed with a nib of absorbent material; such a liquid source is hereinafter referred to as a felt-tipped pen.

The source of gas under pressure may comprise a manually operated pump such as a bellows or squeezable bulb, a foot pump 14 connectable to the inlet nozzle through a hose 16 or a pump including a piston like assembly slidable within a cylinder. Alternatively, the source of gas may include an electric pump 18 or aerosol 20 operable to cause a flow of air under pressure to pass to the nozzle orifice. The electric pump may be powered by replaceable dry cell batteries 22 and may comprise a rotatable fan 24. In these embodiments the gas is air.

As the air flow enters the expansion chamber it accelerates to cause liquid particles to be removed from the surface of the absorbent nib of the source to produce a dispersion of these particles in air.

The casing is preferably produced from a plastics material. Other materials may, however, be used.

The invention will now be described by way of example only with reference to the accompanying diagrammatic drawings in which:

DETAILED DESCRIPTION

Figure 1:
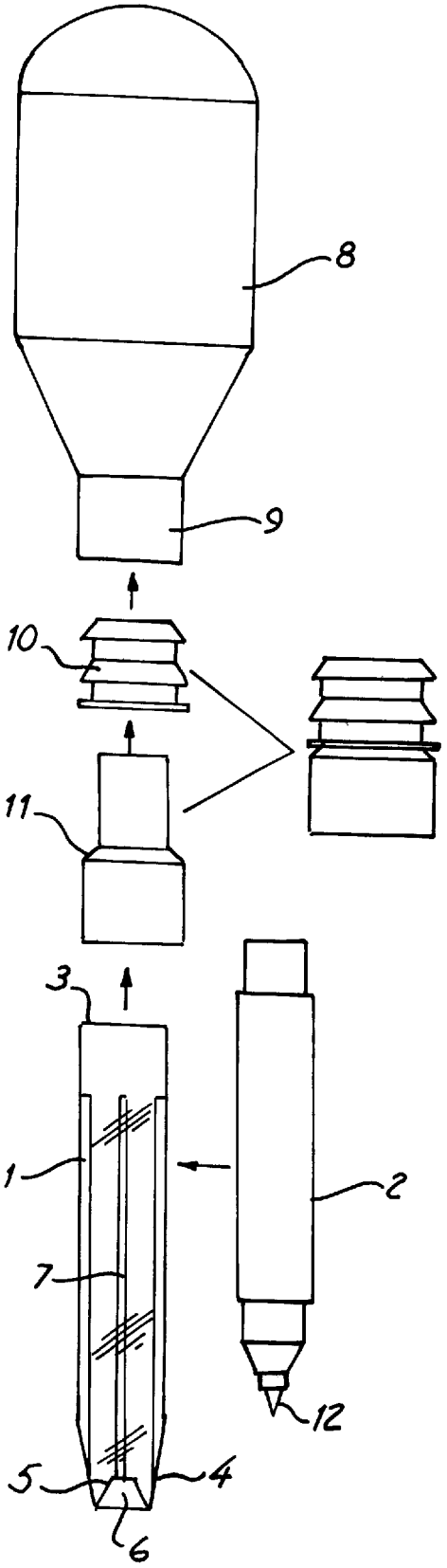
FIGS. 1 and 2 are respectively an exploded side view and a side view partly in section of dispensing apparatus in accordance with the invention.
Figure 2:
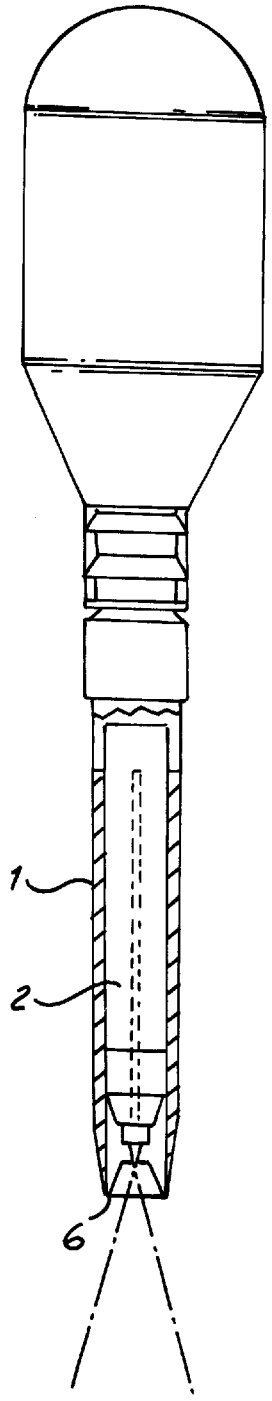
Figure 3A:
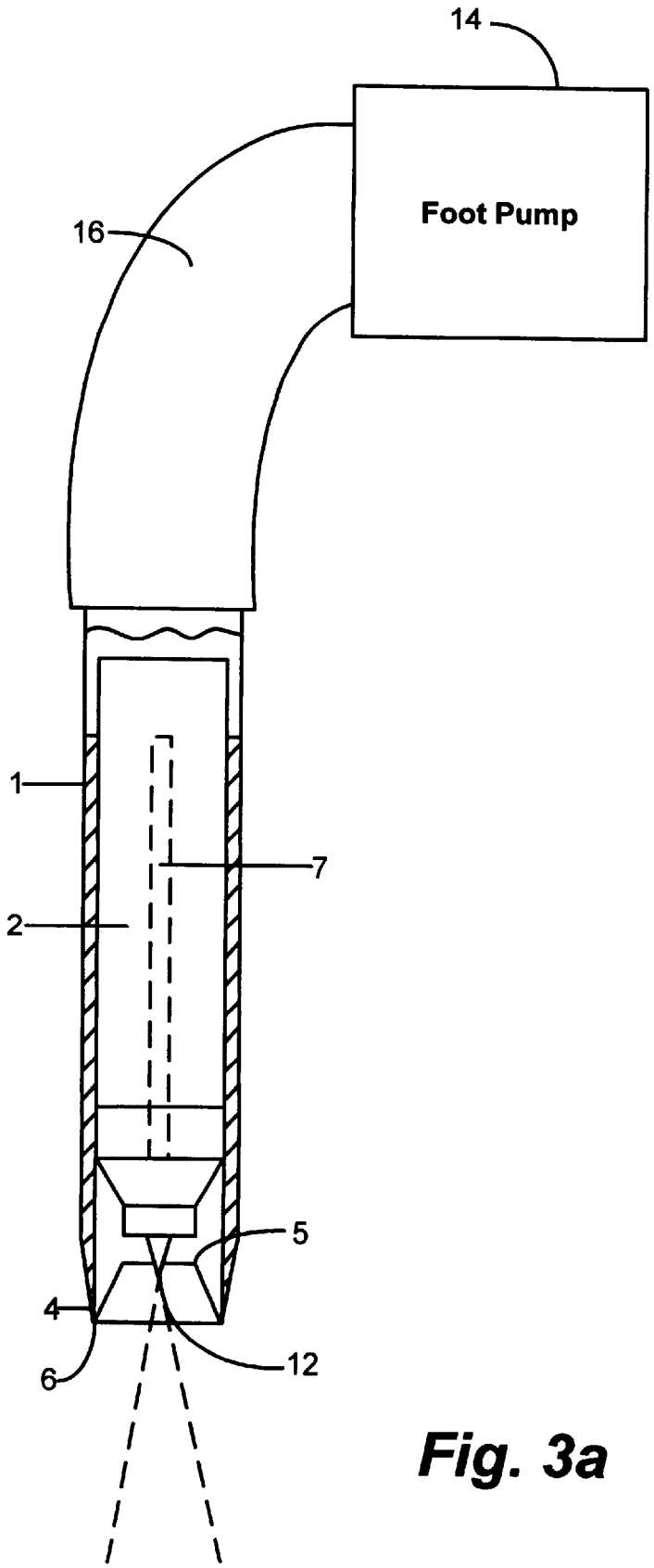
FIGS. 3*a*–3*e* are alternative embodiments of the dispensing apparatus in accordance with the invention.
Figure 3B:
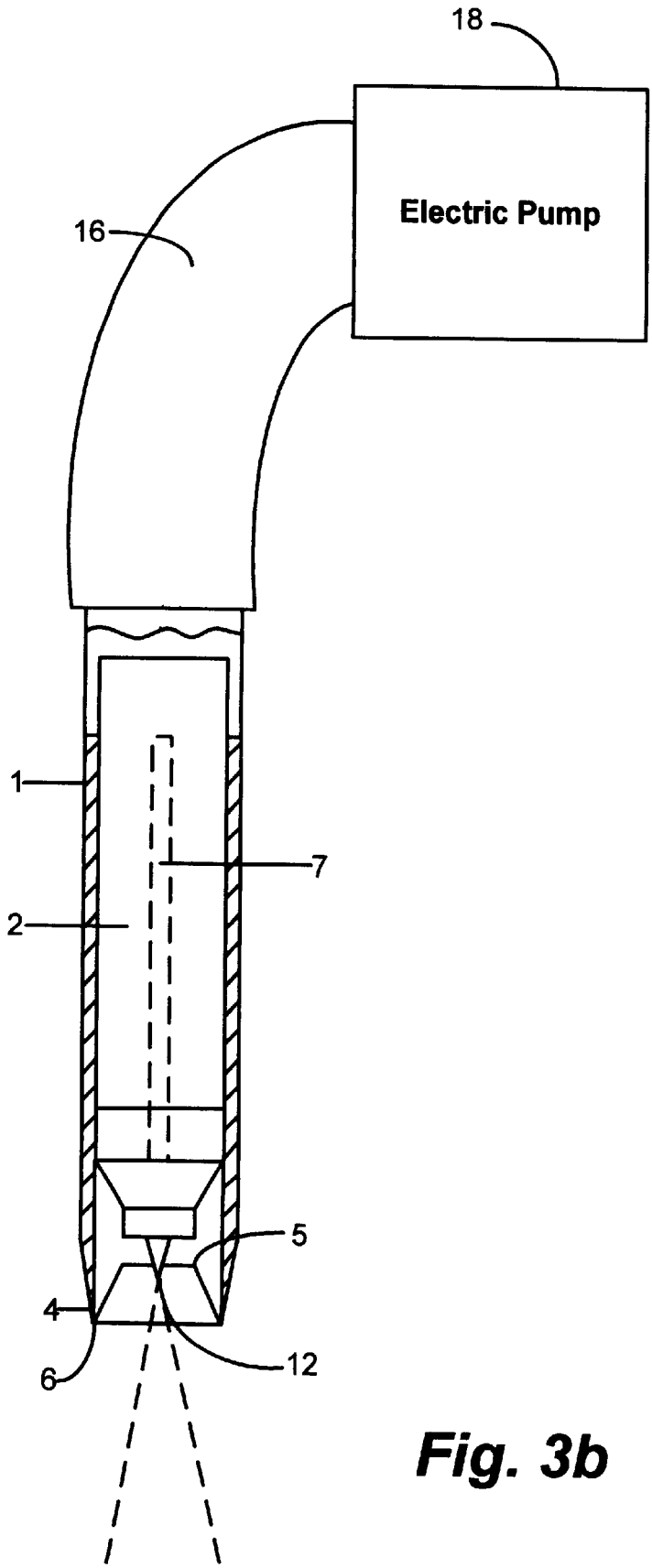
Figure 3C:
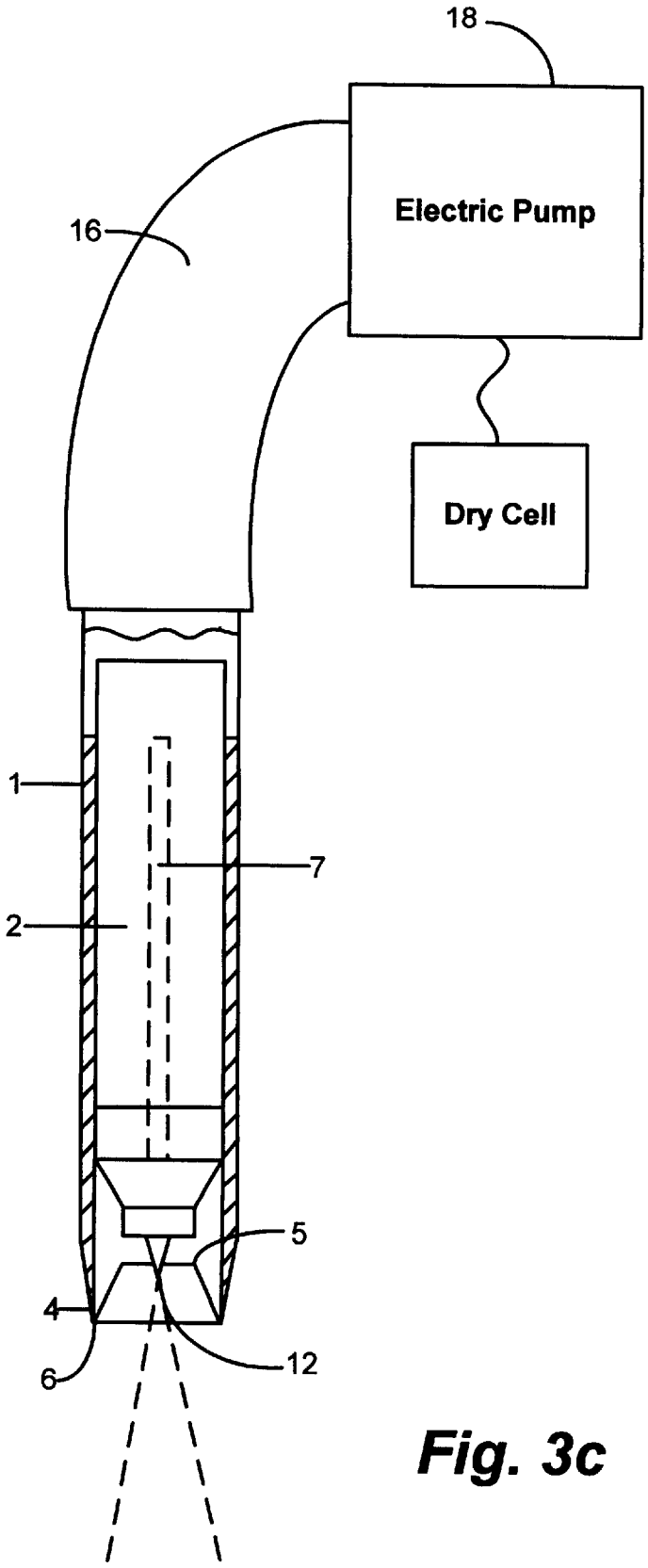
Figure 3D:
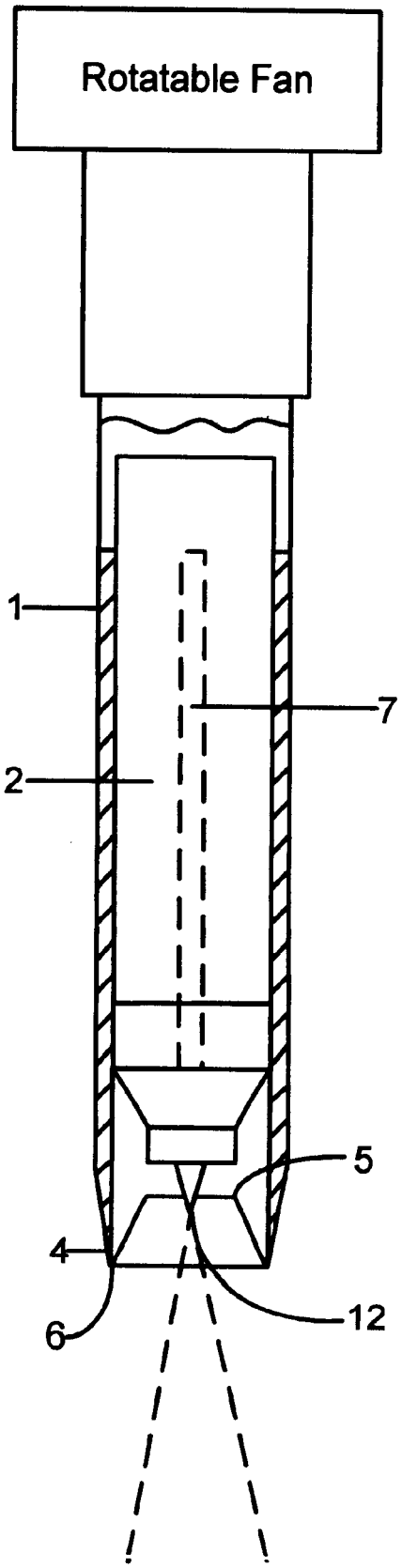
Figure 3E:
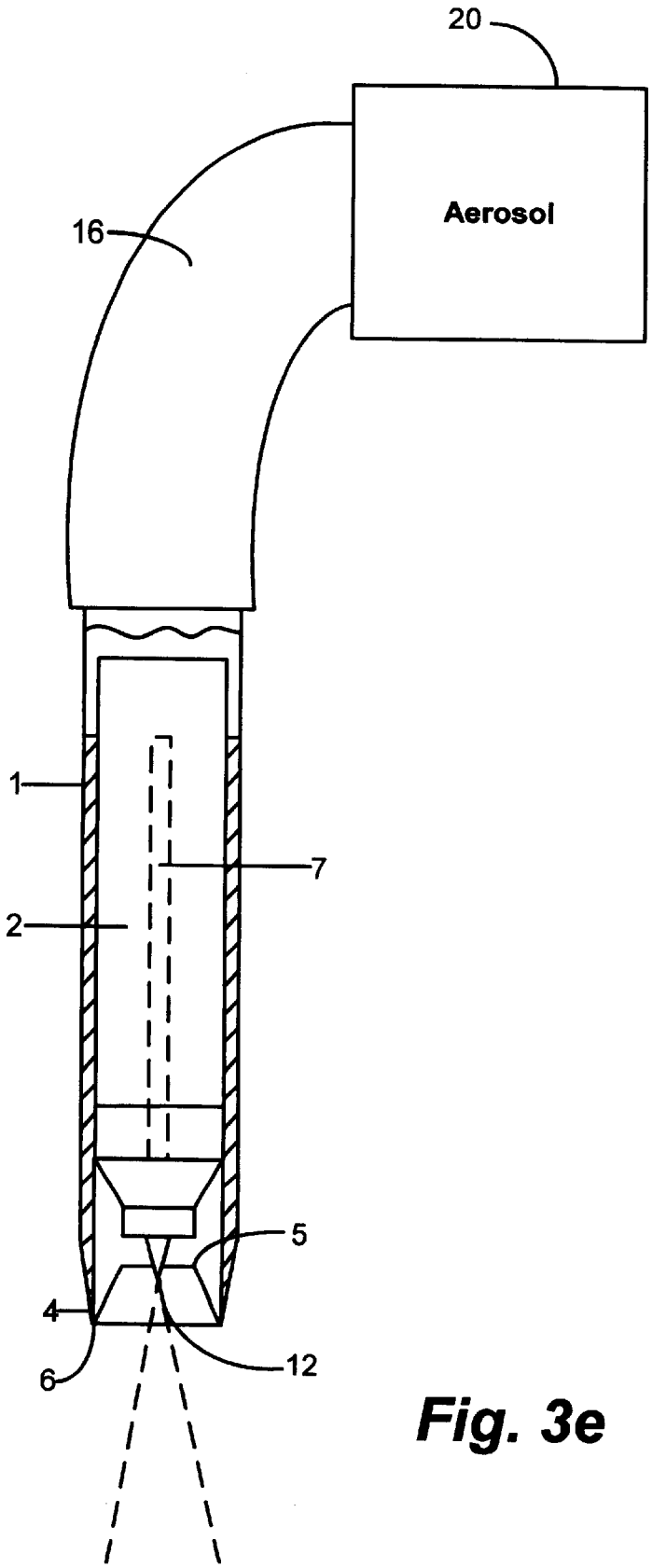

The dispensing apparatus shown in FIGS. 1 and 2 of the drawings, comprises a tubular casing 1 within which is housed a felt-tipped pen 2. The apparatus is shown assembled in FIG. 2. The casing has at one end an inlet nozzle 3 and at its other end a nozzle 4 including an orifice 5 (or smallest throat diameter) which opens into a converging expansion chamber 6 (looking into the expansion chamber from the outlet toward the inlet) or diverging expansion chamber 6 (looking in the direction of gas flow from the inlet through the orifice and into the expansion chamber). Fins 7 protrude inwardly from the internal surfaces of the casing part. A squeezable rubber or plastics bulb 8 whose neck 9 fits over a ribbed connector 10 which in turn is connected to one end of a tubular cap 11. The cap is formed with a widened end which receives and overlies the inlet 3 of the casing 1. The cap and connector are optional features.

The body of the felt-tipped pen 2 has an absorbent nib 12. The absorbent nib defines the required source of liquid to be dispensed and the pen can be positioned within the casing 1 with its nib 12 positioned within or in close proximity to the orifice 5 of the nozzle 4. In this position, the pen is supported centrally within the casing 1 by the fins 7 with a shoulder 14 of the pen body abutting against projecting stops of the fins.

In use, when the bulb 8 is squeezed, air under pressure is caused to flow through the inlet 3 and the annular passageways defined between the opposed surfaces of the pen body 2 and the internal surfaces of the casing 1. The fins 7 ensure that the pen is centralised within the casing. As the blown air approaches the outlet nozzle 4 it passes over the nib 12 and then leaves the casing through the orifice 5 and the expansion chamber 6. As the air enters and passes through the expansion chamber it accelerates thereby inducing a swirling motion which ensures effective removal of liquid particles from the nib 12 of the pen 2. Siting the nib correctly with respect to orifice 5 of the nozzle 4 enables even young children to produce high quality air brush effects when using the apparatus.

In an alternative unillustrated embodiment, the casing is generally triangular in cross-section over a major part of its length with the three sides of the casing acting as locating surfaces to hold the pen in position. Thus, the need for fins 7 is removed. The spaces between the apices of the internal surfaces of the casing and the pen body define the required passageways for the flow of air from the mouthpiece to the nozzle. In other respects, the casing may be the same as that shown in FIGS. 1 and 2.

Other casing shapes having more than three flat sides may be adopted. Thus, the casing may be square or diamond-shaped in cross-section. Also, the casing may be oval in cross-section.

The casing and nozzle may be produced from plastics; other suitable materials may however be employed.

In a further unillustrated embodiment, the casing is made as or assembled into a single piece with the pen permanently located within the casing. In this arrangement, the tips of the fins 7 may be pointed or serrated so that they bite into the surface of the pen as it is loaded into the casing 1. Alternatively, the fins (or the tips thereof) may be of a resilient material which is compressed and deformed by the pen as it is loaded into the casing.

In a further unillustrated embodiment, the casing includes an inner tube within which the pen 2 is positioned relatively tightly. In this arrangement, the inner tube is positioned within and spaced from the internal surface of the casing to define an air flow passage which places the mouthpiece in communication with the casing nozzle. The inner tube is preferably substantially coaxial with the casing.

For all of the various embodiments described above, a finely dispersed spray of coloured ink particles in air is achieved simply by causing air to be blown through the inlet of the respective dispensing apparatus. The improved features of the dispensing apparatus in accordance with the invention enables even young children to reproduce air brush effects normally associated with much more expensive and difficult to operate equipment. Also, it is possible to attach the inlet 3 of the dispensing apparatus to a simple hand or foot operated pump through a flexible tube. This pump may comprise a bellows or foot operated semi-spherical bulb of deformable material. Pumps commonly used to inflate tyres and the like including flexible discs drive along an elongate tubular chamber may also be employed. It is also possible to extend the length of the casing 1 by means of a simple extension tube, one end of the extension tube fitting over the inlet end of the casing.

In an alternative unillustrated embodiment the source of air under pressure is a conventional aerosol can. Thus, the outlet nozzle of an aerosol may be connected via a hose or flexible tube to the inlet 3 of the dispensing apparatus illustrated in FIGS. 1 and 2.

Alternatively, the source of air under pressure may be derived from a battery driven pump or fan positioned within a housing 24 connected or connectable to the inlet 3 of the casing 1 of FIGS. 1 and 2. In this arrangement the pump or fan operates to blow air through its housing and over a felt-tipped pen positioned within the casing. In one arrangement, the pump or fan operates continuously, an aperture being provided within the casing body through which air under pressure leaves without contacting the nib of the pen positioned within the casing, the air being caused to flow over the pen nib when the aperture is closed by the user closing the aperture with, for example, a finger. In another arrangement, a trigger is provided to start and stop the pump or fan.

It will be appreciated that the apparatus described above is merely exemplary of dispensers in accordance with the invention and that modifications can readily be made thereto without departing from the true scope of the invention as set out in the appended claims.

What is claimed is:

1. Liquid dispensing apparatus which comprises a tubular casing having at one end an inlet nozzle connectable to a pump providing a source of gas under pressure and at its other end an outlet nozzle having an orifice defining a smallest throat diameter, the orifice being in communication with an expansion body, the expansion body bounded by sides which, considered in the direction of gas flow, diverge away from the smallest throat diameter of the orifice, and means for locating a liquid source including an elongate body and an absorbent nib at least partially within the casing with the nib extending at least partially within the smallest throat diameter.

2. Apparatus as claimed in claim 1 wherein the liquid source comprises a pen formed with a nib of absorbent material.

3. Apparatus as claimed in claim 2 wherein the pump providing the source of gas under pressure comprises a manually operated pump.

4. Apparatus as claimed in claim 3 wherein the pump comprises a bellows or squeezable bulb.

5. Apparatus as claimed in claim 3 wherein the pump comprises a foot pump connectable to the inlet nozzle through a hose.

6. Apparatus as claimed in claim 1 wherein the pump providing the source of gas under pressure comprises a manually operated pump.

7. Apparatus as claimed in claim 6 wherein the pump comprises a bellows or squeezable bulb.

8. Apparatus as claimed in claim 6 wherein the pump comprises a foot pump connectable to the inlet nozzle through a hose.

9. Apparatus as claimed in claim 1 wherein the pump comprises an electric pump or aerosol operable to cause a flow of air under pressure to pass to the nozzle orifice.

10. Apparatus as claimed in claim 9 wherein the electric pump is powered by replaceable dry cell batteries and may comprise a rotatable fan.

* * * * *